US007559361B2

(12) United States Patent
Obrejanu

(10) Patent No.: US 7,559,361 B2
(45) Date of Patent: Jul. 14, 2009

(54) DOWNHOLE FORCE GENERATOR

(75) Inventor: Marcel Obrejanu, Calgary (CA)

(73) Assignee: Star Oil Tools, Inc., Calgary, Alberta (CA)

( * ) Notice: Subject to any disclaimer, the term of this patent is extended or adjusted under 35 U.S.C. 154(b) by 289 days.

(21) Appl. No.: 11/181,592

(22) Filed: Jul. 14, 2005

(65) Prior Publication Data

US 2007/0012435 A1 Jan. 18, 2007

(51) Int. Cl.
*E21B 31/107* (2006.01)

(52) U.S. Cl. ..... 166/98; 166/301; 166/66.7; 166/381

(58) Field of Classification Search ..... 166/66.7, 166/98, 301, 381
See application file for complete search history.

(56) References Cited

U.S. PATENT DOCUMENTS

| | | | |
|---|---|---|---|
| 3,661,205 | A | 5/1972 | Belorgey |
| 4,493,374 | A | 1/1985 | Magee, Jr. |
| 5,070,941 | A | 12/1991 | Kilgore |
| 5,228,507 | A | 7/1993 | Obrejanu et al. |
| 5,240,077 | A | 8/1993 | Whitsitt |

(Continued)

FOREIGN PATENT DOCUMENTS

CA 2076499 8/1992

(Continued)

OTHER PUBLICATIONS

A Battery-Operated, Electro-Mechanical Setting Tool for Use with Bridge Plugs and Similar Wellbore Tools *I.I. Gazda, SPE, and J.J. Goiffon, S.P.E., Halliburton Energy Services* SPE Drilling & Completion, Jun. 1996, pp. 118-124.

(Continued)

*Primary Examiner*—Jennifer H Gay
*Assistant Examiner*—Brad Harcourt
(74) *Attorney, Agent, or Firm*—Cohen Pontani Lieberman & Pavane LLP

(57) ABSTRACT

A well tool for applying a pulling or a pushing force to an object in an interior of a well bore comprising: a) a inner member comprising an first elongated member, a second elongated member and an actuation means axially interconnecting the first elongated member and the second elongated member; b) an outer elongated member longitudinally moveably engaged with the inner member; c) a first seal defined between the first elongated member and the outer elongated member; d) a second seal defined between the second elongated member and the outer elongated member; e) a first piston area defined at a first end portion of the outer elongated member between an outer diameter of the outer elongated member and a sealed outer diameter of the first elongated member; f) a second piston area defined at a second end portion of the outer elongated member between the outer diameter of the outer elongated member and a sealed outer diameter of the second elongated member; and g) a sealed chamber defined between the first seal and the second seal, the sealed chamber including a fluid at a fluid pressure; wherein operation of the actuation means axially reversibly moves the outer elongated member relative the inner member while the fluid pressure remains constant; and wherein the first piston area and the second piston area are substantially equal and external pressure acting on these two piston areas, generates two opposing forces substantially balanced during relative movement.

15 Claims, 5 Drawing Sheets

U.S. PATENT DOCUMENTS

| | | | | |
|---|---|---|---|---|
| 5,398,753 | A | 3/1995 | Obrejanu et al. | |
| 5,447,202 | A | 9/1995 | Littleford | |
| 5,492,173 | A | 2/1996 | Kilgore et al. | |
| 6,199,628 | B1 | 3/2001 | Beck et al. | |
| 6,367,545 | B1 | 4/2002 | Van Buskirk et al. | |
| 6,722,441 | B2 * | 4/2004 | Lauritzen et al. | 166/380 |
| 6,988,551 | B2 * | 1/2006 | Evans | 166/301 |
| 2004/0045724 | A1 | 3/2004 | Buyers et al. | |
| 2005/0056427 | A1 | 3/2005 | Clemens et al. | |

FOREIGN PATENT DOCUMENTS

| | | | |
|---|---|---|---|
| CA | 2170711 | | 2/1996 |
| GB | 2267922 | A | 8/1993 |
| WO | WO 02/29201 | A1 | 4/2002 |

OTHER PUBLICATIONS http://www.industrialnewsroom.com/fullstory/19728 Aug. 3, 2004 pp. 1 to 3.

* cited by examiner

DOWNHOLE FORCE GENERATOR

FIELD OF THE INVENTION

This invention relates to equipment for generating a force in a wellbore and more particularly but not limited to setting and retrieval tools for use in oil and gas wells.

BACKGROUND OF THE INVENTION

The structure of a wellbore of an oil or gas well generally consists of an outer production casing and an inner production tubing installed inside the production casing. The production tubing extends from the surface to the required depth in the wellbore for production of the oil or gas. Various tools such as plugs, chokes, safety valves, check valves, etc. can be placed in landing nipples in the production tubing to allow for different production operations or the downhole control of fluid flow. Also, tools like bridge plugs, packers and flow control equipment are placed in the production casing to control production or stimulation operations. Force generating tools are needed both to exert a pushing force to set the tools in the landing nipples and to provide a pulling force to retrieve the tools. It is preferable to have the force generating tools pressure balanced so that the same force may be applied both in pulling and in pushing operations, irrespective of the pressure in the wellbore.

A downhole force generator is disclosed in U.S. Pat. No. 6,199,628. A downhole force generator is disclosed in U.S. Pat. No. 5,070,941. A locator and setting tool is disclosed in Canadian Patent No. 2,170,711. These 3 patents describe virtually the same technology, in different variations. None of these prior art tools are pressure balanced to provide equal force in pulling and pushing operations. As detailed in the article published by Halliburton Energy Services in the June 1996 edition of the SPE Drilling & Completion magazine, "Any pressure differential increases the available force with the DPU in tension and decreases the setting force in the extension mode. This is because (1) the DPU is sealed to the well pressure through redundant sealing elements maintaining internal parts at near-atmospheric pressure, and (2) the well pressure acts on the power rod's sealed diameter." This is a disadvantage, especially in high-pressure wells. A high enough downhole pressure will render these tools unusable. Additionally, none of these tools provide a simple mechanical tool, particularly for the retrieval of downhole tools.

SUMMARY OF THE INVENTION

According to one broad aspect, the invention provides a well tool for applying a pulling or a pushing force to an object in an interior of a well bore comprising: a) a drive mandrel; b) an engaging mandrel; c) an actuation means; d) a housing sealing a portion of the drive mandrel and a portion of the engaging mandrel within an interior space, the drive mandrel and the engaging mandrel extending from opposite ends of the housing; e) a drive mandrel piston area defined at a drive mandrel end portion of the housing between a outside diameter of the housing and a sealed diameter of the drive mandrel; and f) an engaging mandrel piston area defined at an engaging mandrel end portion of the housing between the outside diameter of the housing and a sealed diameter of the engaging mandrel; wherein the actuation means is adapted to reversibly move the housing longitudinally relative to the drive mandrel and the engaging mandrel and wherein the drive mandrel piston area and the engaging mandrel piston area are substantially equal and external pressure acting on these two piston areas, generates two opposing forces that are substantially balanced during relative movement.

According to another broad aspect, the invention provides a well tool for applying a pulling or a pushing force to an object in an interior of a well bore comprising: a) an inner elongated member; b) an outer elongated member; c) a sealed interior defined between the inner elongated member and the outer elongated member; and d) an actuation means defined at least partially within the sealed interior; wherein the actuation means is adapted to reversibly move the outer elongated member longitudinally over the inner elongated member and wherein the inner elongated member and the outer elongated member are arranged such that a volume of the sealed interior occupied by the inner elongated member remains substantially constant as the inner elongated member and the outer elongated member move relative to each other.

According to a further broad aspect, the invention provides a well tool for applying a pulling or a pushing force to an object in an interior of a well bore comprising: a) an inner elongated member; b) an outer elongated member encircling an intermediate segment of and longitudinally moveably engaged with the inner elongated member; c) a screw component of the inner elongated member, the screw component being coupled for rotation about a longitudinal axis; and d) a threaded component of the outer elongated member engaged with the screw component; wherein rotation of the screw component reversibly moves the outer elongated member relative to the inner elongated member.

According to a still further broad aspect, the invention provides a well tool for applying a pulling or a pushing force to an object in an interior of a well bore comprising: a) an inner member comprising a first elongated member, a second elongated member and an actuation means axially interconnecting the first elongated member and the second elongated member; b) an outer elongated member longitudinally moveably engaged with the inner member; c) a first seal defined between the first elongated member and the outer elongated member; d) a second seal defined between the second elongated member and the outer elongated member; e) a first piston area defined at a first end portion of the outer elongated member between an outer diameter of the outer elongated member and a sealed outer diameter of the first elongated member; f) a second piston area defined at a second end portion of the outer elongated member between the outer diameter of the outer elongated member and a sealed outer diameter of the second elongated member; and g) a sealed chamber defined between the first seal and the second seal, the sealed chamber including a fluid at a fluid pressure; wherein operation of the actuation means axially reversibly moves the outer elongated member relative the inner member while the fluid pressure remains constant; and wherein the first piston area and the second piston area are substantially equal and external pressure acting on these two pistons areas, generates two opposing forces that are substantially balanced during relative movement.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
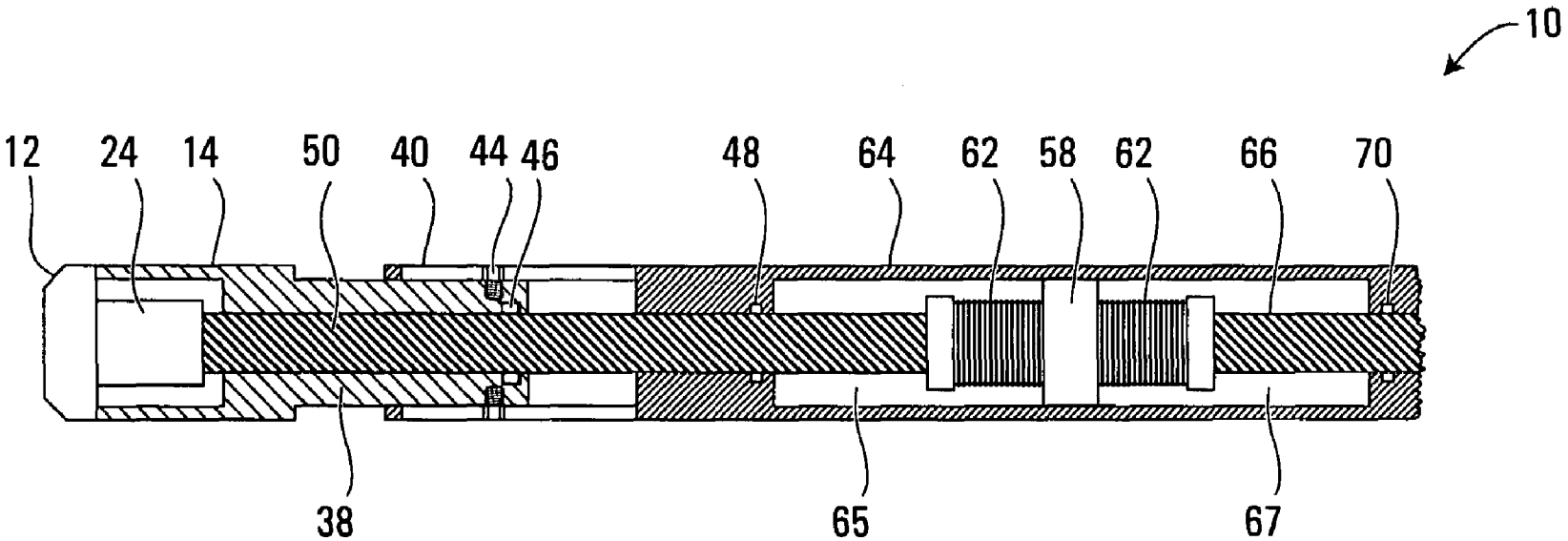
FIG. 1 is a partial schematic cross-sectional view of a first embodiment of the invention.

FIG. 1 shows a cross-sectional view of a simplified embodiment of the invention. A tool 10 has an inner elongated member which includes a drive mandrel 50, a screw 62 and an engaging mandrel 66. The engaging mandrel may be a setting or a retrieving mandrel. The drive mandrel 50 and the screw 62 are axially coupled for both rotational and longitudinal movement. The engaging mandrel 66 and the screw 62 are preferably coupled for longitudinal movement only. The cross-sectional area of the drive mandrel 50 is substantially equal to the cross-sectional area of the engaging mandrel 66.

The tool 10 also includes an outer elongated member or main housing 64. The outside diameter of the main housing 64 is preferably constant. Fixed to the interior of the main housing 64 is a threaded component or nut 58. The nut 58 is threaded on the screw 62. One end of the main housing 64 is sealed to the drive mandrel 50 by a seal 48. The other end of the main housing 64 is sealed to the engaging mandrel 66 by a seal 70. The sealed interior of the main housing 64 is preferably equalized with the wellbore pressure. The connection between the screw 62 and the nut 58 is not fluid tight, i.e. chambers 65 and 67 on either side of the nut 58 are enclosed by the main housing 64 and are in fluid communication through gaps between the screw 62 and nut 58 and/or channels milled on the outside of the nut 58.

The drive mandrel 50 is coupled at its other end to a motor 24. The motor 24 is contained within a motor housing 14. A connector 12 is provided at the other end of the motor for electrically and mechanically connecting the tool 10. Cap screws 44 are provided in a guide sleeve 38 formed at the end of the motor housing 14 which encircles the drive mandrel 50 and an electronics seal 46 is provided around the drive mandrel 50 which seals the guide sleeve to the mandrel 50 to protect the inside of the motor housing 14 from the environment. A guide housing extension 40 of the main housing 64 slidably encompasses a portion of the guide sleeve 38. The cap screws 44 travel in slots in the guide housing extension 40 and prevent rotation of the main housing 64.

In operation, the connector 12 is electrically and mechanically connected to a wireline. The motor 24 rotates the drive mandrel 50. Rotation of the drive mandrel 50 causes the screw 62 to rotate. The main housing 64 is held against rotation so that rotation of the screw 62 causes the main housing 64 to move longitudinally over the inner elongated member. At all times, the volume of the drive mandrel entering/exiting the interior space is the same as the volume of the engaging mandrel exiting/entering the interior space so that the free volume, and therefore also the pressure, in the interior space remains constant. The seals 48 and 70, define two hydraulic pistons between the outside diameter of the main housing 64 and the outside diameter of the drive mandrel 50 and the outside diameter of the engaging mandrel 66 respectively. The two piston areas have the same area. Any outside well pressure acting on these two hydraulic piston areas will create two equal opposing forces that cancel each other. The constant volume in the interior and the matched piston areas enable the same force to be applied by the tool in both the pushing and the pulling operations. The main housing 64 and/or the engaging mandrel 66 are coupled to engaging tools for setting or retrieval of downhole tools.

Figure 2A:
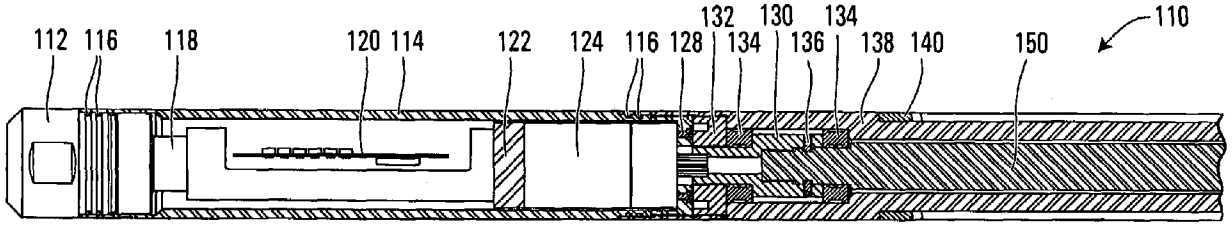
FIGS. 2A, 2B and 2C are detailed top, middle and bottom cross-sectional views, respectively, of the first embodiment of the invention in a first position.
Figure 2B:
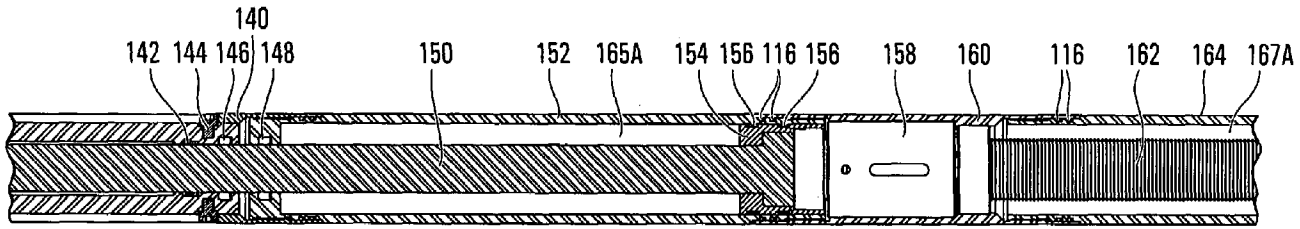
Figure 2C:
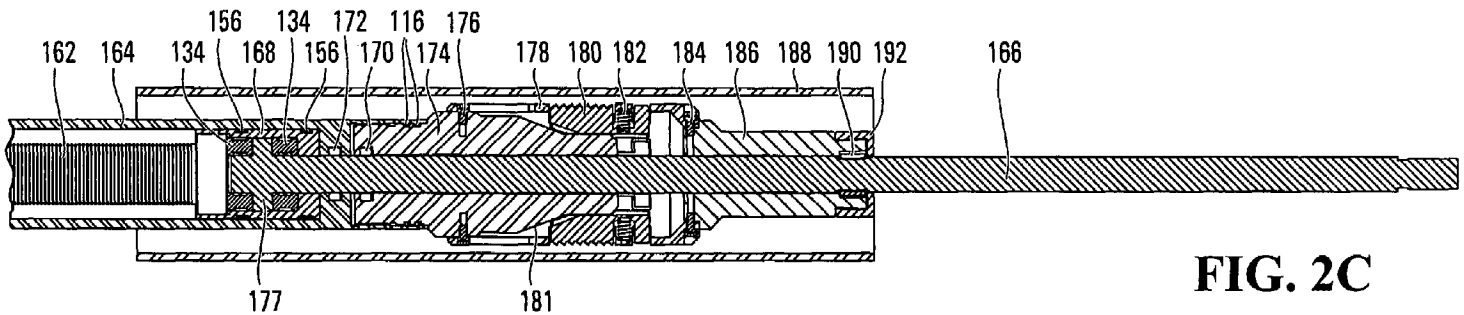

In greater detail, FIGS. 2A to 2C depict a well tool, in particular a wireline retrieving tool for applying a pulling force to an object in the interior of a wellbore. The wireline retrieving tool 110 is generally tubular in shape. A connector 112 is located at the proximal end of the wireline retrieving tool 110. The connector 112 allows for mechanical and electrical connection of the wireline retrieving tool 110 to a wireline. The connector 112 connects to a proximal end of a tubular electronics housing 114. Seals 116 are provided at the interface between the connector 112 and the electronics housing 114 to seal the interior of the electronics housing 114 from the environment. The electronics housing 114 houses an electronics carrier 118, a printed circuit board 120, a digital positioning encoder 122 and a gear motor 124. The electronics carrier provides mechanical support for the printed circuit board 120. The connector 112 is connected to the printed circuit board 120 to provide power to the printed circuit board from the wireline. The printed circuit board 120 provides control for the operation of the digital positioning encoder 122 and the gear motor 124. The digital positioning encoder 122 is connected at one end of the gear motor 124. The digital positioning encoder 122 counts the rotation of the gear motor 124 to allow precise calculation and control of the movement of the distal end of the wireline retrieving tool 110.

A distal end of the electronics housing 114 is connected to a guide sleeve 138. The guide sleeve is generally tubular. Seals 116 are provided between the guide sleeve 138 and the electronics housing 114 to seal the interior from the environment. A drive mandrel 150 extends at least partially through the guide sleeve 138. The drive mandrel 150 is generally an elongated solid member with a circular cross-section. The drive mandrel 150 is interconnected to the gear motor 124 through a spline adapter 130. The spline adapter 130 interconnects the gear motor 124 to the drive mandrel 150 through axial splines so that rotation of an output of the gear motor 124 results in rotation of the drive mandrel 150 at the same speed. The spline adaptor 130 is threaded to the drive mandrel 150. Set screws 136 hold the drive mandrel 150 in position relative to the spline adapter 130.

Thrust bearings 134 are provided at support ends of the spline adapter 130 to facilitate smooth rotation of the drive mandrel 150 relative to the guide sleeve and the electronics housing. A drive mandrel lock nut 132 is provided to retain the bearings 134 and the spline adaptor in the guide sleeve 138 and cap screws 128 are provided to fasten the gear motor to the distal end of the electronics housing 114.

Cap screws 144 are provided at a distal end of the guide sleeve 138. Heads of the cap screws 144 project outward from the surface of the guide sleeve 138. An upper guide housing 140 slidably encompasses a portion of the guide sleeve 138. Longitudinal slots are defined in the upper guide housing 140. The cap screws 144 travel within the longitudinal slots in the upper guide housing 140 when the upper guide housing 140 slides relative to the guide sleeve 138. The cap screws 144 rest against the ends of the longitudinal slots to retain the upper guide housing 140 in contact with the guide sleeve 138 at the limits of relative travel and prevent relative rotation between the guide housing 138 and the upper guide housing 140.

A glide ring 142 is also provided adjacent the cap screws 144 between the guide sleeve 138 and the drive mandrel 150 to facilitate the smooth rotation of the drive mandrel 150. An electronics seal 146 is provided around the drive mandrel 150 at the distal end of the guide sleeve 138. The electronics seal 146 seals the electronic section from external contaminants and keeps it at atmospheric pressure.

The distal end of the upper guide housing 140 mates with a proximal end of an upper housing 152. The upper housing 152 is also generally tubular. The upper guide housing 140 and the upper housing 152 are retained relative to one another by a threaded connection. An upper interior area seal 148 is provided at a proximal end of the upper housing 152 and seals the upper housing 152 to the drive mandrel 150. The upper internal area seal 148 seals the interior of the upper housing 152. The electronics seal 146 and the upper internal area seal 148 allow for rotation of the drive mandrel 150.

A distal end of the upper housing 152 is coupled to a proximal end of an actuator housing 160. The actuator housing 160 is generally tubular. An actuator nut 158 is non-rotatably held within the actuator housing 160. An actuator screw 162 extends through the actuator nut 158. The actuator screw 162 is coupled to a distal end of the drive mandrel 150. The coupling is provided by an anti-rotational lug so that the actuator screw 162 rotates with the drive mandrel 150. A drive mandrel retainer 154 is provided within the upper housing 152 which maintains the drive mandrel 150 in contact with the actuator screw 162. Glide rings 156 are provided around the circumference of the drive mandrel retainer 154 to allow smooth rotation of the drive mandrel retainer 154 within the upper housing 152.

Figure 3A:
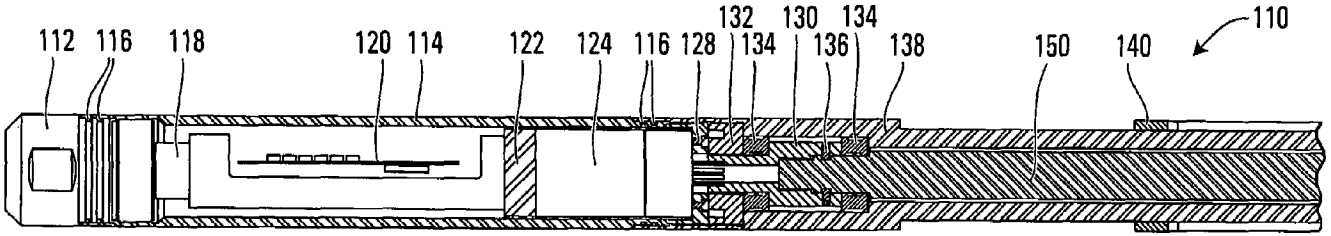
FIGS. 3A, 3B and 3C are detailed top, middle and bottom cross-sectional views, respectively, of the embodiment of FIGS. 2A, 2B and 2C in a second position.
Figure 3B:
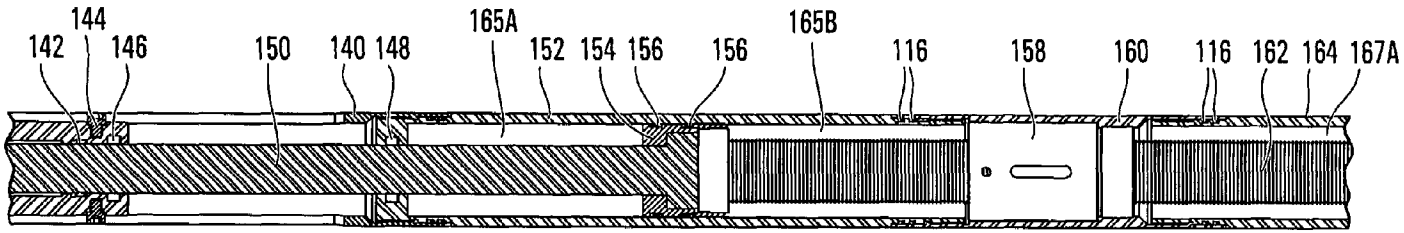
Figure 3C:
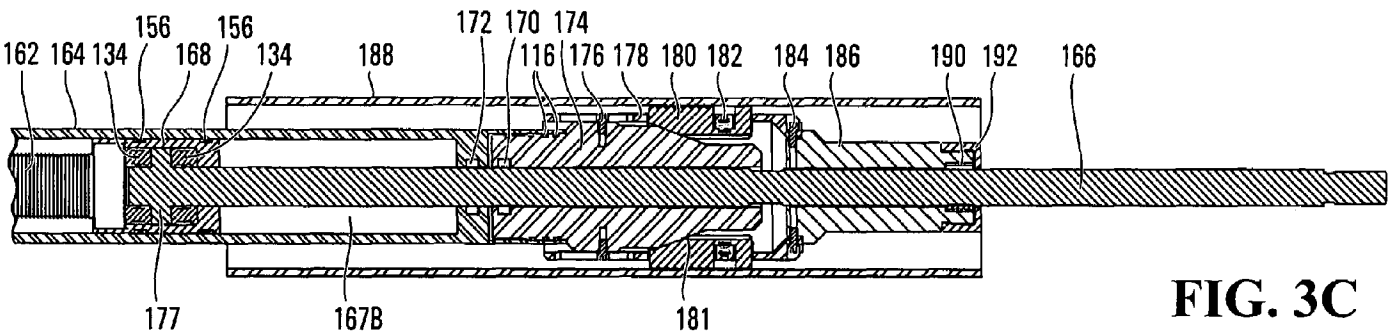

Upper chambers 165A and 165B (FIG. 3) are defined within the upper housing 152 which accommodate the drive mandrel retainer 154 when the upper housing 152 moves longitudinally relative to the drive mandrel 150. Upper chambers 165A and 165B are in permanent communication.

Seals 116 are provided at the interface of the upper housing 152 and the actuator housing 160 to protect the interior of the upper chambers from the environment. A bottom housing 164 connects to the distal end of the actuator housing 160. Seals 116 are provided between bottom housing 164 and the actuator housing 160 to protect the interior from the environment.

The actuator screw 162 extends through the bottom housing 164. The actuator nut 158 is engaged with the actuator screw 162 such that rotation of the actuator screw 162 moves the actuator nut 158 relative to the actuator screw 162. Other screw components and threaded components may be utilized.

The distal end of the actuator screw 162 is coupled to a retrieving mandrel 166. The retrieving mandrel 166 is generally an elongated solid member with a circular cross-section of substantially the same diameter as the drive mandrel 150. The actuator screw 162 is coupled to the retrieving mandrel 166 by a retrieving mandrel retainer 168. The proximal end of the retrieving mandrel 166 adjacent to the actuator screw 162 has a shoulder 177. On either sides of the shoulder 177 are thrust bearings 134. The thrust bearings 134 allow longitudinal movement of the actuator screw 162 to be transmitted to the retrieving mandrel 166 but rotational movement of the actuator 162 is not transmitted to the retrieving mandrel 166 such that retrieving mandrel 166 moves longitudinally but does not rotate. Glide rings 156 are positioned between the retrieving mandrel retainer 168 and the bottom housing 164 to allow smooth longitudinal and rotational movement of the retrieving mandrel retainer 168 relative to the bottom housing 164.

Bottom chambers 167A and 167B are defined within the bottom housing 164 which accommodate the retrieving mandrel retainer 168 when the bottom housing 164 moves longitudinally relative to the retrieving mandrel 166. The bottom chambers 167A and 167B are in permanent communication.

A distal end of the bottom housing 164 is coupled to a setting cone 174. Seals 116 are provided between the bottom housing 164 and the setting cone 174. A lower internal area seal 170 is provided between the setting cone 174 and the retrieving mandrel 166. A lower secondary interior area seal 172 is provided between the bottom housing 164 and the retrieving mandrel 166. The lower internal seal 170 provides a primary seal to seal the interior of the bottom housing 164 from the external environment. The lower secondary interior seal 172 provides a backup seal.

A slip cage 178 holds a set of slips 180 on the setting cone 174. Cap screws 176 connect the slip cage 178 to the setting cone 174. The slip cage 178 is moveable relative to the setting cone 174 by movement of the cap screws 176 in slots defined in the slip cage 178. The slips 180 are biased inward by springs 182.

A C-ring 190 is provided which sits in a circumferential recess in the retrieving mandrel 166. The C-ring 190 sits inside a C-ring housing 186 which is connected to the setting cone 174 by cap screws 184. The C-ring 190 is retained within the C-ring housing 186 by a C-ring retainer 192. A segment of the production tubing or casing 188 is shown to facilitate the explanation of the operation of the wireline retrieving tool 110.

The drive mandrel 150 and the retrieving mandrel 166 are of substantially the same diameter so that the volume of either mandrel entering the sealed interior defined by the upper housing 152, the actuator housing 160, and the bottom housing 164 is substantially the same as the volume of the other mandrel exiting the sealed interior so that the free volume within the sealed interior remains substantially constant. A hydraulic piston defined between the outside diameter of the upper housing 152 and the outside diameter of the drive mandrel 150 and a hydraulic piston defined between the outside diameter of the bottom housing 164 and the outside diameter of the retrieving mandrel 166 are equal in area. Any outside well pressure acting on these two hydraulic piston areas will create two equal opposing forces that cancel each other. This provides the same power availability for pushing and pulling.

Figure 4A:
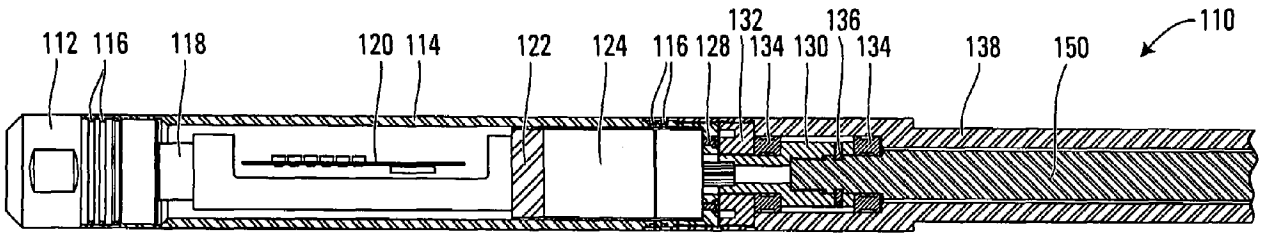
FIGS. 4A, 4B and 4C are detailed top, middle and bottom cross-sectional views, respectively, of the embodiment of FIGS. 2A, 2B and 2C in a third position.
Figure 4B:
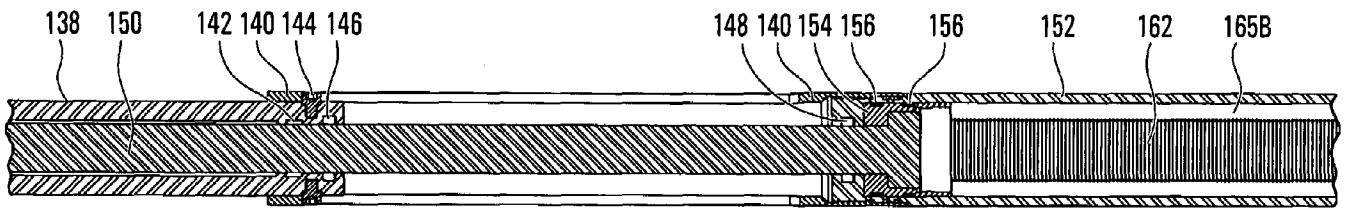
Figure 4C:
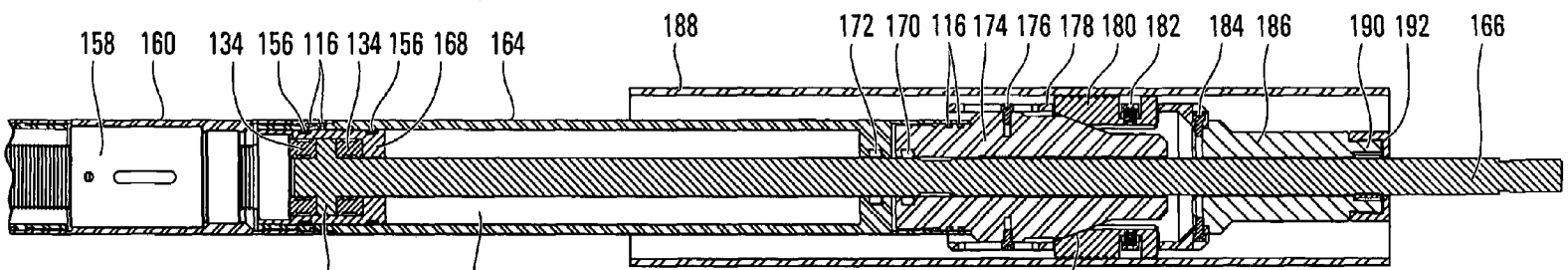

The operation of the wireline retrieving tool 110 is explained with reference to FIGS. 2, 3 and 4 which shows the wireline retrieving tool 110 in three different positions. The same reference characters are used in all three figures to refer to the same elements. In operation, the wireline retrieving tool 110 is connected by connector 112 to a wireline, both electrically and mechanically. The wireline retrieving tool is lowered into a segment of the production tubing or casing 188 to a desired location. At that location, the gear motor 124 is operated via the printed circuit board 120. The digital positioning encoder 122 counts the rotations of the gear motor 124 so that an exact position of the retrieving mandrel 166 can be obtained. Rotation of the gear motor 124 is translated to the drive mandrel 150 to provide rotation of the drive mandrel 150.

In the initial position depicted in FIG. 2, only chambers 165A and 167A are open. The drive mandrel 150 is coupled to the actuator screw 162 as noted above so that rotation of the drive mandrel 150 provides rotation of the actuator screw 162 at the same rate of rotation. Rotation of the actuator screw 162 moves the actuator nut 158 downward along the actuator screw 162 as seen in FIG. 3. This opens up chambers-165B and 167B at the same rate that chambers 165A and 167A are closed. The movement of the actuator nut 158 in turn moves the upper guide housing 140, the upper housing 152, the actuator housing 160 and the bottom housing 164 downward. The bottom housing 164 in turn pushes the setting cone 174 downward.

The C-ring housing is held against downward movements by the C-ring 190 seated in the recess on the retrieving mandrel 166. This also holds the slips 180 stationary relative to the retrieving mandrel 166. The setting cone 174 slides relative to the slips 180. The setting cone 174 has a narrower end initially within the slips 180 and expands along a shoulder 181 to a wider section. As the shoulder 181 is forced through the slips 180, the slips are moved outward, the springs 182 are compressed and the slips bite into the segment of production tubing or casing 188 and hold the slips stationary relative to the production tubing or casing 188 (see FIGS. 3A to 3C). Further rotation of the actuator screw 162 no longer moves the housing downwardly, instead, further rotation of the actuator screw 162 will force the expansion and release the C-ring 190 from the retrieving mandrel 166 and the proximal end of the wireline retrieving tool 110 moves upwardly to the upper limit of travel shown in FIGS. 4A to 4C. In this final position, chambers 165A and 167A are completely closed and chambers 165B and 167B are completely open.

All of chambers 165A, 165B, 167A and 167B are in fluid communication through gaps between the actuator screw 162 and the actuator nut 158 and gaps between the coupling assemblies interconnecting the actuator screw 152 to the mandrels 150 and 166 and the housings 152 and 164. The mandrels 150 and 166 have substantially the same cross section. As a result, the combined free volume of the chambers 165A, 165B, 167A and 167B remains substantially constant throughout the relative movement of the housings so that the pressure within the sealed interior of the tool 110 remains constant. Also, because the mandrels 150 and 166 have the same cross section, any outside well pressure acting on the two opposing hydraulic pistons defined by the outside diameter of the housings 152 and 164 and the outside diameters of the mandrels 150 and 166, would generate two equal opposing forces that would cancel each other and would not affect the function of the tool in pushing or pulling operations.

In operation, a fishing tool is attached to the distal end of the wireline retrieving tool 110. The further rotation of the actuator screw 162 pulls the fishing tool upward against the holding force of the slips against the segment of production tubing or casing 188. Thus, the pulling force is not provided by the wireline but instead by the action of the retrieving mandrel 166 against the slips 180.

To reset the tool, the actuator screw 162 is rotated in the opposite direction causing the upper guide housing 140, the upper housing 152, the actuator nut 158, the actuator housing 160, the bottom housing 164 and the setting cone 174 to move upward. The withdrawal of the shoulder 181 of the setting cone 174 from the slip 180 results in the springs 182 retracting the slips 180 from contact with the segment of production tubing or casing 188. The wireline retrieving tool 110 can then be withdrawn from the production tubing or casing. Alternatively, if the object to be retrieved is not completely free, the wireline retrieving tool 110 can be partially withdrawn up the production tubing or casing 188 and reset to perform a second or other subsequent pulling operation in the same manner as described above.

Figure 5A:
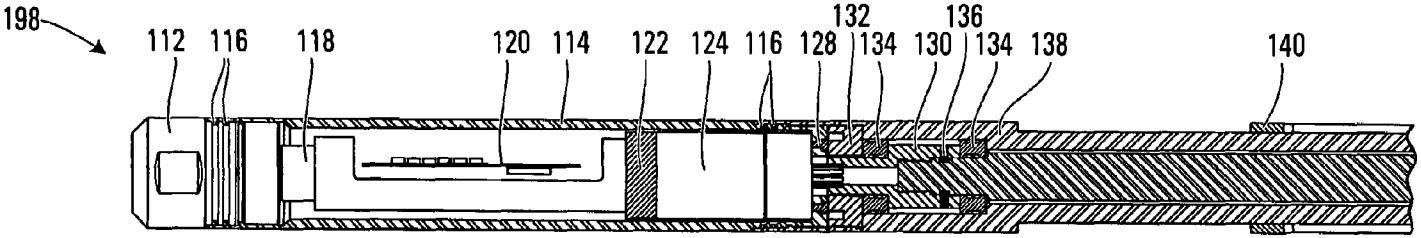
FIGS. 5A, 5B and 5C are detailed top, middle and bottom cross-sectional views, respectively, of a second embodiment of the invention.
Figure 5B:
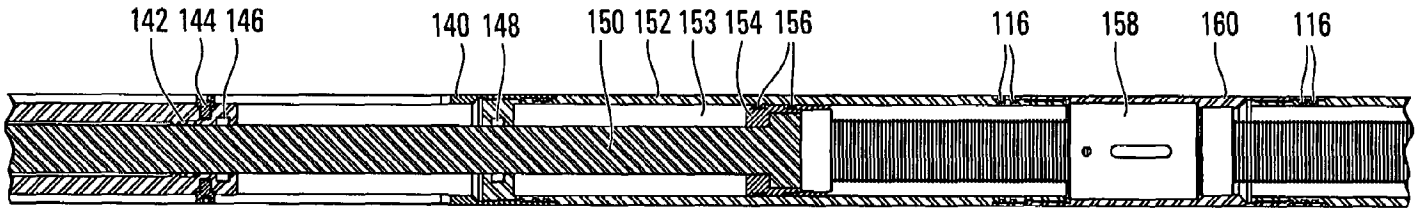
Figure 5C:
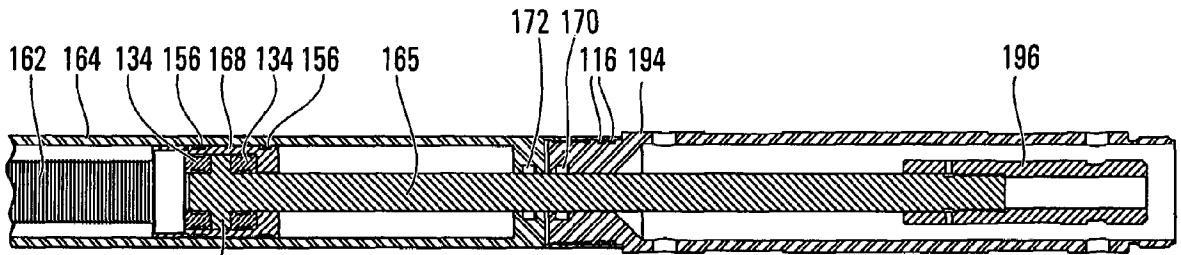

FIGS. 5A to 5C depicts a wireline setting tool 198. The same reference characters are used in FIGS. 5A to 5C for the same components as identified in FIGS. 2A to 4C. It can be seen that the only difference between the wireline retrieving tool 110 of FIGS. 2A to 4C and the wireline setting tool 198 of FIGS. 5A to 5C is the assembly at the distal end. In particular, the wireline setting tool 198 does not contain a slip assembly. Instead, a setting housing 194 is connected at the end of the bottom housing 164. As with the wireline retrieving tool 110, a lower internal area seal 170 seals against a mandrel, in this case a setting mandrel 165, of substantially the same diameter as the upper interior seal 148 which seals against the drive mandrel 150. A setting adapter 196 is fixed to the distal end of the setting mandrel 165. A tool to be set is fixed to the end of the setting housing 194 and the setting adapter 196. When the wireline setting tool 198 is actuated in the manner as described with regard to the wireline retrieving tool 110, the housings 140, 152, 160, 164 and 194 move downward over the setting mandrel 165 and the force thus exerted is used to set a tool to be placed in the production tubing or casing (not shown). In FIGS. 5A to 5C, the wireline setting tool 198 is shown with the actuator nut 158 in an intermediate position such that the housings are partly but not fully extended.

The number of housings depicted in FIGS. 2A to 5C is based, at least in part, on manufacturing concerns. The invention encompasses tools having more or fewer housings. The tubular shape of the housings is preferred but not essential.

Although seals are depicted throughout the figures, seals may be unnecessary between the relatively stationary parts if a sufficiently tight fit is present.

The mechanical means of interconnecting the various components of the tool shown in the figures are exemplary only. Other known mechanical means of interconnecting the various components are contemplated by the invention.

Numerous modifications and variations of the present invention are possible in light of the above teachings. It is therefore to be understood that within the scope of the appended claims, the invention may be practiced otherwise than as specifically described herein.

The invention claimed is:

1. A well tool for applying a pulling or a pushing force to an object in an interior of a well bore, comprising:

a) a drive mandrel;

b) an engaging mandrel;

c) an actuator;

d) a housing sealing a portion of the drive mandrel and a portion of the engaging mandrel within an interior space, the drive mandrel and the engaging mandrel extending from opposite ends of the housing;

e) a drive mandrel piston area defined at a drive mandrel end portion of the housing between an outside diameter of the housing and an outside diameter of the drive mandrel sealed at the housing; and f) an engaging mandrel piston area defined at an engaging mandrel end portion of the housing between the outside diameter of the housing and an outside diameter of the engaging mandrel sealed at the housing;

wherein the actuator is adapted to reversibly move the housing longitudinally relative to the drive mandrel and the engaging mandrel, and wherein the drive mandrel piston area and the engaging mandrel piston area are substantially equal so that external pressure acting on the two piston areas, generates two opposing forces that are substantially balanced during relative movement.

2. The well tool according to claim 1 wherein the actuator comprises:

a) a screw component interconnecting the drive mandrel and the engaging mandrel, the screw component being coupled to the drive mandrel for rotation in common about a longitudinal axis; and b) a threaded component interior to the housing and engaged with the screw component;

wherein the rotation of the screw component moves the housing relative to the engaging mandrel and the drive mandrel.

3. The well tool according to claim 2 further comprising a thrust bearing coupling the engaging mandrel to the screw component wherein only longitudinal movement of the screw component is transmitted to the engaging mandrel.

4. The well tool according to claim 1 wherein the actuator is adapted to maintain a pressure within the interior space substantially constant during the relative movement.

5. The well tool according to claim 1 wherein the drive mandrel and the engaging mandrel are cylindrical and of substantially the same diameter.

6. The well tool according to claim 1 further comprising an anchor for selectively anchoring a distal end of the engaging mandrel to an interior wall of a well bore.

7. The well tool according to claim 1 further comprising a motor housing coupled to the drive mandrel wherein cooperating protrusions and longitudinal slots are defined on the housing and on the motor housing and wherein the protrusions slide within the slots during the relative movement.

8. A well tool for applying a pulling or a pushing force to an object in an interior of a well bore, comprising:

a) an inner elongated member;

b) an outer elongated member;

c) a sealed interior defined between the inner elongated member and the outer elongated member; and d) an actuator defined at least partially within the sealed interior;

wherein the actuator is adapted to reversibly move the outer elongated member longitudinally over the inner elongated member, and wherein the inner elongated member and the outer elongated member are arranged such that a volume of the sealed interior occupied by the inner elongated member remains substantially constant as the inner elongated member and the outer elongated member move relative to each other.

9. The well tool according to claim 8 wherein the actuator comprises:

a) a screw component of the inner elongated member extending longitudinally within the sealed interior, the screw component being rotatable about a longitudinal axis; and b) a threaded component of the outer elongated member within the sealed interior engaged with the screw component;

wherein the rotation of the screw component moves the outer elongated member relative to the inner elongated member.

10. The well tool according to claim 9 wherein the inner elongated member includes a drive mandrel axially coupled to a first end of the screw component and an engaging mandrel axially coupled to a second end of the screw component.

11. The well tool according to claim 10 wherein the drive mandrel and the engaging mandrel are of substantially the same diameter and the outer elongated member seals on the drive mandrel and the engaging mandrel to define the sealed interior.

12. The well tool according to claim 10 further comprising a thrust bearing coupling the engaging mandrel to the screw component wherein only longitudinal movement of the screw component is transmitted to the engaging mandrel.

13. The well tool according to claim 8 further comprising an anchor for selectively anchoring a distal end of the outer elongated member to an interior wall of a well bore.

14. The well tool according to claim 8 wherein cooperating protrusions and longitudinal slots are defined on the inner elongated member and the outer elongated member and the protrusions slide within the slots when the inner elongated member moves relative to the outer elongated member.

15. A well tool for applying a pulling or a pushing force to an object in an interior of a well bore, comprising:

a) a inner member comprising a first elongated member, a second elongated member and an actuator axially interconnecting the first elongated member and the second elongated member;

b) an outer elongated member longitudinally moveably engaged with the inner member;

c) a first seal defined between the first elongated member and the outer elongated member;

d) a second seal defined between the second elongated member and the outer elongated member;

e) a first piston area defined at a first end portion of the outer elongated member between an outer diameter of the outer elongated member and a sealed outer diameter of the first elongated member;

f) a second piston area defined at a second end portion of the outer elongated member between the outer diameter of the outer elongated member and a sealed outer diameter of the second elongated member; and g) a sealed chamber defined between the first seal and the second seal, the sealed chamber including a fluid at a fluid pressure;

wherein operation of the actuator axially reversibly moves the outer elongated member relative the inner member while the fluid pressure remains constant; and wherein the first piston area and the second piston area are substantially equal and external pressure acting on the two piston areas, generates two opposing forces that are substantially balanced during relative movement.

* * * * *